United States Patent [19]

Ibbott

[11] Patent Number: 4,703,754

[45] Date of Patent: Nov. 3, 1987

[54] INSOLE EMPLOYING SHEETLIKE BATTERY

[76] Inventor: Jack K. Ibbott, 17-7, Nishiazabu 4-chome, Minato-ku, Tokyo 106, Japan

[21] Appl. No.: 691,300

[22] PCT Filed: Apr. 19, 1984

[86] PCT No.: PCT/JP84/00204

§ 371 Date: Dec. 14, 1984

§ 102(e) Date: Dec. 14, 1984

[87] PCT Pub. No.: WO84/04026

PCT Pub. Date: Oct. 25, 1984

[30] Foreign Application Priority Data

Apr. 19, 1983 [JP] Japan ..... 58-67876

[51] Int. Cl.[4] ..... A61N 1/30

[52] U.S. Cl. ..... 128/383; 36/44; 429/127

[58] Field of Search ..... 128/382, 383, 362; 36/43, 44; 429/127; 604/20

[56] References Cited

U.S. PATENT DOCUMENTS

| | | | |
|---|---|---|---|
| 282,784 | 8/1883 | Schlosser | 429/68 |
| 1,032,324 | 7/1912 | Breakfield | 128/391 |
| 1,469,968 | 10/1923 | Solliday | 128/383 |
| 2,666,802 | 1/1954 | Wodning et al. | 429/162 |
| 2,762,858 | 9/1956 | Wood | 429/162 |
| 3,314,820 | 4/1967 | Smith | 29/623.4 |
| 3,485,677 | 12/1969 | Balaguer | 429/94 |
| 3,617,387 | 11/1971 | Grulke et al. | 429/162 |
| 4,142,521 | 3/1979 | Konikoff | 128/821 |
| 4,474,570 | 10/1984 | Airura et al. | 128/198 |

FOREIGN PATENT DOCUMENTS

| | | | |
|---|---|---|---|
| 1020740 | 12/1957 | Fed. Rep. of Germany . | |
| 7305806 | 2/1973 | Japan . | |
| 67238 | 1/1914 | Switzerland | 128/383 |

OTHER PUBLICATIONS

Kellogg II, E. W., *Air Ions: Their Possible Significance and Effects,* Journal of Bioelectricity, 3(1 & 2), 119–136 (1984).

Taubes, Gary, *An Electrifying Possibility,* Discover, pp. 23–37 (Apr. 1986).

*Primary Examiner*—Anton O. Oechsle

*Attorney, Agent, or Firm*—Wenderoth, Lind & Ponack

[57] ABSTRACT

An insole employing a sheetlike battery is formed in conformity to the sole of a foot, and includes a positive electrode in the form of sheet densely containing carbon fibers or fine carbon particles, a negative electrode of a metal foil such as aluminum or zinc, and an electrolyte interposed between the two electrodes.

9 Claims, 3 Drawing Figures

INSOLE EMPLOYING SHEETLIKE BATTERY

BACKGROUND OF THE INVENTION

The present invention relates to an insole which is removably placed between the sole of a foot and the inside sole of a shoe. Heretofore, a variety of insoles have been proposed for curing athelete's foot and eliminating the unpleasant smell of a shoe. Most of them are incorporated with magnets, activated carbon, or copper sheet or wires. However, insoles of sch construction cannot produce the desired effect.

SUMMARY OF THE INVENTION

The present invention was completed based on the unique sheetlike battery disclosed in PCT/JP84/00100 filed by the present inventor, corresponding to U.S. patent application Ser. No. 675,060, filed Nov. 7, 1984 now U.S. Pat. No. 4,614,695. It is an object of this invention to provide an insole made of a sheetlike battery and which is superior in curing athlete's foot and other skin diseases and in eliminating the unpleasant smell of a shoe.

As disclosed in the specification of PCT/JP84/00100, the present inventor has developed a sheetlike battery composed of a positive electrode in the form of a sheet densely containing carbon fibers or fine carbon particles, a negative electrode of aluminum or zinc foil, and an electrolyte such as office paste interposed between the two electrodes. In experiments performed in searching for applications of such sheetlike battery, the present inventor has found that it effectively cures skin diseases or the like when the negative electrode side of the sheetlike battery is kept in contact with the skin of the human body. This finding led to the present invention.

The gist of this invention resides in an insole which is formed by cutting a sheetlike battery of the above-mentioned structure into the form of a sole of a foot. When in use, the insole is placed in a shoe such that the positive electrode contacts the inside sole of the shoe and that a sole of a foot is placed above the negative electrode. Preferably, the negative electrode of metal foil is covered with a moisture absorbent material.

The reasons why the above-mentioned insole cures skin diseases such as athlete's foot and eliminates the unpleasant smell of a shoe can be considered from various experiments of the present inventor, as follows:

(1) First, it is considered that when electric energy flows through the human body, some kinds of disease germs and bacteria are killed or the activities thereof are suppressed. That is, in the experiments of the present inventor, when the insole of the present invention was used in a shoe, which had been repeatedly worn for such a long period of time that sweat was absorbed inside the shoe and, as a result, gave off an unpleasant smell and was infected by bacteria, the unpleasant smell disappeared completely in a very short time.

In another experiment, it was found that when the present insole was used by those who were suffering from athlete's foot with itchy erythemas on the soles of their feet, itchness was removed almost immediately and did not appear again thereafter.

From the experiments set forth above, it could be assumed that the electric energy generated by the sheetlike battery constituting the insole flows from the positive electrode to the negative electrode through the moist inside sole and wall of the shoe, during which the electric energy kills bacteria on the inner wall of the shoe to eliminate the unpleasant smell and destroys germs causing athlete's foot.

(2) It is also considered that the body fluids and self-curing ingredients therein flow along with the movement of the electric energy and are absorbed into the body part to which the negative electrode of the battery abuts, so that skin diseases and the like at said body part are cured.

In the experiments conducted by the present inventor, it was observed that when the sheetlike battery is kept in contact with the affected part of the skin, a large amount of moisture (sweat) oozes out of the affected part. It is considered from this fact that the body fluids move along the flow of the electric energy and ooze out at the body part contacting the negative electrode of the sheetlike battery. As is well known, body fluids contain some ingredients which cure a wound and the like by themselves, so that it is considered that these ingredients are also drawn, like the above-mentioned moisture, to the body part contacting the negative electrode of the battery to promote curing. In other experiments, where the sheetlike battery was attached to a very dry part of the skin, such a change was observed that the part of the skin contacting the battery became moist after several minutes. This will mean that moisture in the tissue of the human body is drawn to the skin surface. In view of the fact that the body moisture permeates through the part where the battery is attached, it can be considered that the self-curing ingredients naturally existing in the body will also be drawn to the battery contacting part together with the moisture, whereby the skin disease, wound or the like is cured rapidly.

(3) It is considered that the therapeutic effect of the battery is caused by the increase of minus (−) ions at the body part contacting the negative electrode of the battery, as the electric energy generated by the battery flows through the human body.

That is, these minus (−) ions are effective for the human body, and it is known that by increasing the amount of minus ions, therapeutic effects such as killing of bacteria, sanitary effects such as deodorizing, and many other healthful effects can be obtained. Namely, when the materials such as various liquid ingredients (mineral etc.) in the human body, exist in the liquid state, these materials are equilibrated in the form of plus ions and minus ions in the liquid. When an electric current, however small it may be, flows through such ionized materials, the plus ions and minus ions are attracted to the respective points where the plus and minus are applied in the current and are highly concentrated at these points. Accordingly, it can be considered that when the above described sheetlike battery is attached in such a manner that the negative electrode side comes into contact with the sole of a human body, due to the small electric current caused by such attachment of the battery, minus ions in the body fluids are drawn through the tissues of the sole to the part where the negative electrode of the battery contacts and are concentrated thereat, whereby skin diseases or the like at the body part are cured.

Preferred embodiments of the present invention will be described with reference to the accompanying drawings.

DETAILED DESCRIPTION OF THE INVENTION

Figure 1:
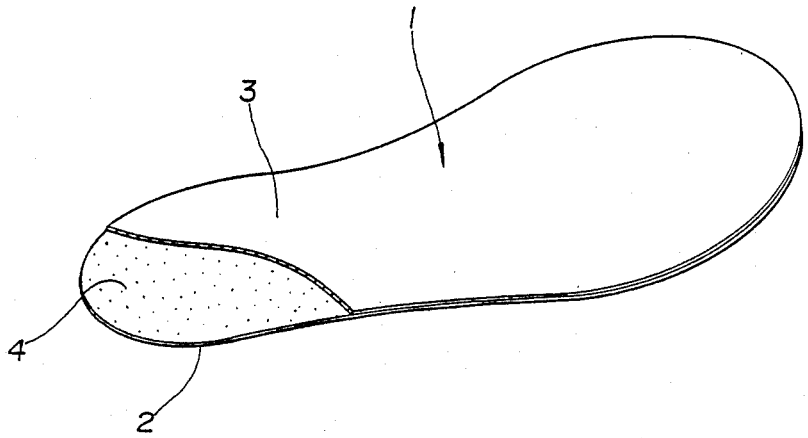
FIG. 1 is a partly cutaway perspective view of an insole of a first embodiment of this invention.

FIG. 1 shows an insole of the present invention made of a sheetlike battery. The insole 1 comprises a positive electrode 2 in the form of a sheet densely containing carbon fibers or fine carbon particles, a negative electrode 3 of metal foil such as aluminum or zinc, and an electrolyte 4 interposed between the two electrodes. The sheetlike material of the positive electrode is preferably made of fibrous paper, and the negative electrode 3 is preferably made of aluminum foil. The insole made of such a sheetlike battery can be made as thin as 1 mm or less. It is as flexible as ordinary cardboard and can be cut into a desired shape with scissors. The sheetlike battery generates a voltage of about 0.8 to 1.2 V.

The insole of this invention is produced by cutting the sheetlike battery into the pattern of a foot sole. When in use, it is placed in a shoe, with the positive electrode 2 downward. Accordingly, when a shoe 5 having this insole 1 inserted therein is worn, the positive electrode 2 of the sheetlike battery comes into contact with the inside sole of the shoe, and the negative electrode 3 comes into contact with the sole of a foot of the wearer of the shoe.

Figure 2:
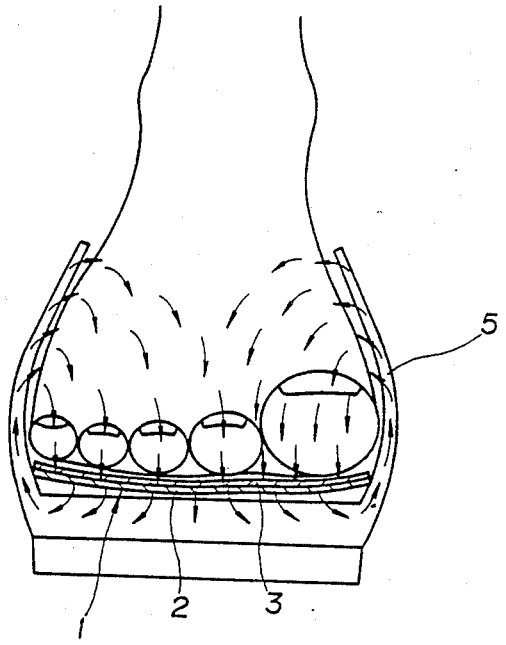
FIGS. 2 and 3 are sectional views respectively showing insoles of the first and second embodiments of the present invention, which are placed on the inside soles of shoes for use.

In this state of use, an electric circuit for flowing a small amount of electric current is formed, as shown by arrows in FIG. 2, from positive electrode 2 of the insole 1 made of the sheetlike battery to the negative electrode 3 of the insole 1 through the inner wall of the shoe 5 containing moisture such as sweat and through the inner tissue of the foot contacting the inner wall of the shoe 5. Thus, when the small electric current flows through the part of the foot sole contacting the negative electrode 3, bacteria at this part is killed or the activity thereof is suppressed, the self-curing constituents in the foot sole tissues are drawn to the negative side, and further minus ions are concentrated at the foot sole, as mentioned above in (1), (2) and (3). These actions collectively cure athlete's foot and eliminate the unpleasant smell of the shoe.

Figure 3:
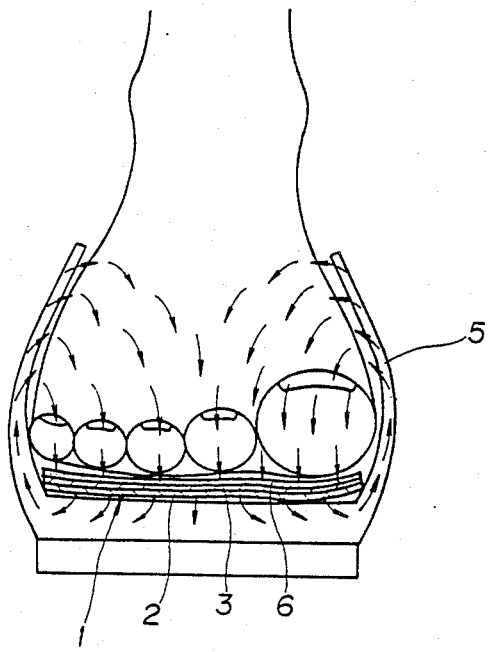

FIG. 3 shows an insole 1*a* according to the second embodiment of the present invention, wherein an absorbent material 6 made of cloth, sponge, foam or the like covers the negative electrode 3 of the insole 1*a* made of a sheetlike battery. This absorbent material is intended to absorb the moisture which permeates out the foot sole as mentioned above in (2) and also to keep the foot warm in winter and cool in summer.

The absorbent material 6 does not interfere with the formation of the electric current from the positive electrode to the negative electrode of the sheetlike battery because it becomes conductive upon absorption of moisture.

As mentioned above, the insole of the present invention is quite unique in that it is made of a sheetlike battery and it has remarkable effects in curing skin diseases such as athlete's foot and eliminating the unpleasant smell of shoes.

I claim:

1. A method for therapeutic treatment of a foot by employing a footwear insole comprising an electric energy producing element, said method comprising placing said footwear insole in an article of footwear and providing a first electric polarity directed to the sole of said foot and a second opposing electric polarity directed to the inner sole of said article of footwear, and by the conductivity of body moisture contained within said article of footwear forming an electric circuit to flow electric energy to said sole of said foot and through said conductive body moisture contained in said footwear to an upper part of said foot.

2. A footwear insole comprising a sheetlike battery member cut to a shape and size to fit an article of footwear from a large sheetlike battery, ssaid sheetlike battery member comprising a flexible positive electrode sheet member, a flexible negative sheet member and an electrolyte between said electrode sheet members, said sheetlike battery member having a flexibility similar to a laminated paper to thereby conform to the shape of the insole of the foot of a user, and said positive and said negative electrode sheet members being of the same size and shape and extending throughout said sheetlike battery member.

3. A footwear insole as claimed in claim 2, wherein the surface of said negative electrode sheet member of said sheetlike battery member is covered with an absorbent material.

4. A footwear insole as claimed in claim 2, wherein said negative electrode sheet member of said sheetlike battery is made of aluminum foil or zinc foil.

5. A footwear insole as claimed in claim 2, wherein said electrolyte of said sheetlike battery is an adhesive.

6. A footwear insole comprising a sheetlike battery member cut to a shape and size to fit an article of footwear from a large sheetlike battery, said sheetlike battery member comprising a flexible positive electrode sheet member, a flexible negative electrode sheet member and an electrolyte between said electrode sheet members, said sheetlike battery member having a flexibility similar to a laminated paper to thereby conform to the shape of the sole of a foot of a user, and said positive electrode sheet member of said sheetlike battery member comprising fibrous material and carbon.

7. A footwear insole as claimed in claim 6, wherein the surface of said negative electrode sheet member of said sheet like battery member is covered with an absorbent material.

8. A footwear insole as claimed in claim 6, wherein said negative electrode sheet member of said sheetlike battery is made of aluminum foil or zinc foil.

9. A footwear insole as claimed in claim 6, wherein said electrolyte of said sheetlike battery is an adhesive.

* * * * *